US009878227B2

(12) United States Patent
Kozac

(10) Patent No.: US 9,878,227 B2
(45) Date of Patent: Jan. 30, 2018

(54) KOZAC CUT GOALIE HOCKEY STICK

(71) Applicant: Jonathan Kozac, Tempe, AZ (US)

(72) Inventor: Jonathan Kozac, Tempe, AZ (US)

( * ) Notice: Subject to any disclaimer, the term of this patent is extended or adjusted under 35 U.S.C. 154(b) by 72 days.

(21) Appl. No.: 14/999,496

(22) Filed: May 16, 2016

(65) Prior Publication Data

US 2017/0326423 A1 Nov. 16, 2017

(51) Int. Cl.
*A63B 59/00* (2015.01)
*A63B 59/70* (2015.01)

(52) U.S. Cl.
CPC ..... *A63B 59/70* (2015.10)

(58) Field of Classification Search
CPC ..... A63B 59/70; A63B 2102/24
USPC ..... 473/560
See application file for complete search history.

(56) References Cited

U.S. PATENT DOCUMENTS

D263,329 S * 3/1982 Clayton ..... D21/727
4,544,157 A * 10/1985 Curtis ..... A63B 59/70 473/560
5,333,857 A * 8/1994 Lallemand ..... A63B 59/70 473/561
5,853,338 A * 12/1998 Ubriaco ..... A63B 59/70 473/562
6,068,563 A * 5/2000 Bengtsson ..... A63B 59/70 473/560

* cited by examiner

*Primary Examiner* — Joshua T Kennedy

(57) ABSTRACT

A goalie hockey stick including a shaft with two bends in it, a vertical paddle and a blade with an added bend that allows goaltenders to play their position with the goal of stopping the puck from scoring by blocking the puck or deflecting the puck away from the opening of the goal. It also allows the goalie to play, control, pass and shoot the puck both standing and on their knees.

1 Claim, 2 Drawing Sheets

KOZAC CUT GOALIE HOCKEY STICK

The KOZAC CUT goalie stick provides modern day ice hockey goalies with a new concept in goalie stick design. As all goalie sticks to date have a straight paddle that connects to the blade. The KOZAC CUT adds a PADDLE/BLADE that connects the lower blade of the stick to the upper paddle allowing the goaltender to drop to their knees during play and still have a portion of the PADDLE/BLADE flush to the ice, therefore protecting the "5 HOLE". The "5 HOLE" is the area between the goalies knees up to the pelvis. The added PADDLE/BLADE also allows the goalie to play the puck while on their knees.

Goalie sticks were created for "STAND UP" style goalies, over the years the sport has evolved and today over 95% of goaltenders are now "BUTTERFLY" style goaltenders. A BUTTERFLY style goaltender drops to the ice with their knees together and their skates pushed out towards the posts. Once down in the BUTTERFLY position, present day goalie sticks prevent the goalie from playing the puck, protecting their "5 HOLE" or stopping a puck that has been shot on the ice towards the goaltenders stick side.

Along with the added PADDLE/BLADE, the KOZAC CUT also has two bends in the shaft. The first bend is located just above the upper paddle and allows the goalie to hold the stick horizontally onto the ice with the upper paddle and the shaft flush to the ice. With the incorporation of a second bend near the end of the top of the shaft, it allows the goalie to tape the end of the shaft without raising the surface contact area. This enables the goalie to pick up the stick from the ice with one hand quickly, while still allowing the goalie to place the stick with the upper paddle and shaft flush onto the ice. Being able to do this will more effectively help the goalie stop pucks that are shot at the goal on the ice while the goalie is down on their knees. With the ability to apply a large amount of tape to the top of the shaft, the amount of vibration felt upon impact of the puck to the stick will be greatly reduced.

The KOZAC CUT will benefit all Butterfly style goaltenders by giving them the ability to protect their "5 HOLE" as well as the ice on the "STICK" side of their body. It will also reduce the amount of vibration felt when their stick is struck by the puck, and finally will give them the opportunity to play, control and pass the puck while standing or while on their knees which present day goalies sticks do not allow.

DESCRIPTION OF THE DRAWINGS

Detailed Description of the Present Invention

The Kozac Cut hockey goalie stick.

Figure 1:
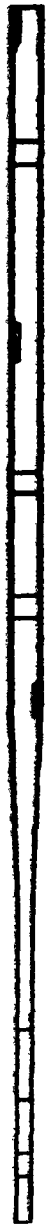
Figure 2:
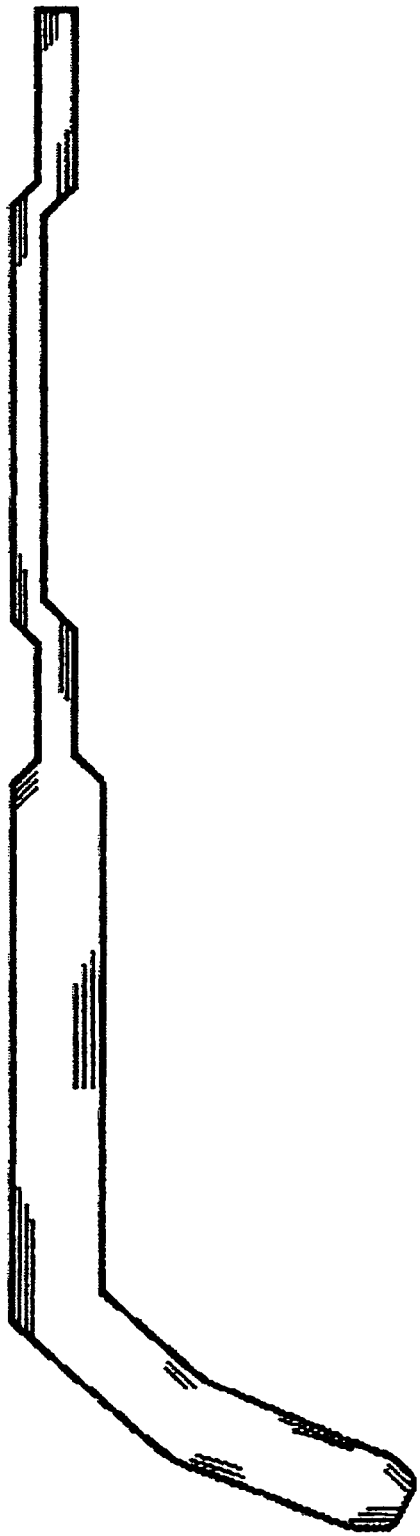

To further describe the present invention, the following references FIGS. 1 and 2.

Drawing FIG. 1 is a front view of the invention, hockey goalie stick, The Kozac Cut, in a vertical position drawn in approximate aspect with dimension, Drawing FIG. 2 is a side view of the invention, hockey goalie stick, The Kozac Cut, in a vertical position drawn in approximate aspect with dimensions.

A. The goalie stick, The Kozac Cut, shown in FIG. 1 and FIG. 2 is a hockey stick with intended use by a goalie in the game of hockey.

B. Those skilled in the art will realize that the game of hockey may include, ice hockey, roller hockey, ball hockey and any other variation of the game in which an object such as a puck is moved across a playing surface with the assistance of a stick. A playing surface may include ice or any other surface upon which the game of hockey is played.

C. Similarly the term "puck" as used herein may include a conventional hockey puck, a ball or other object so used in any game of hockey.

D. The goalie stick, The Kozac Cut, as shown in FIG. 2, has features similar to those features found in conventional goalie hockey sticks including a shaft, a paddle and a blade, all of which are rigidly attached. The shaft, which is normally straight, is modified with the present invention, The Kozac Cut. As a goalie crouches or goes down on his/her knees, the middle shaft remains in contact with the playing surface to prevent the puck (or object) from advancing past the player while the player's hands remain on the grips. This is a significant change and is described further in paragraph (J).

E. The second modification changes the normally curved surface between the shaft and blade. The Kozac Cut flattens the curved area between the paddle and lower blade to add an additional flat surface, upper blade. For the goalie playing in a crouched position or on their knees, this adds an additional level of protection between the knees in preventing the puck (or object) from penetrating the goalie position and entering the net.

F. In some hockey goalie sticks the longitudinal axis of the shaft is parallel to the axis of the paddle. Other hockey goalie sticks are built in a non-parallel position to affect contact with the playing surface while playing different angles and body positions. The Kozac Cut retains the parallel shaft and paddle axis but offsets the grips to facilitate surface contact. This affects the total shaft/paddle area in contact with the playing surface, which increases the effectiveness of the entire stick. It maximizes the sticks total surface area in contact with the playing surface. (ice, or other surface material)

G. The angle of the blade is designed to make contact with the playing surface as the goalie makes defensive adjustments in his/her stance. The blade's present invention, adds additional surface contact when the goalie is in a kneeling position (45 degree angle) and maintains an (30 degree angle) when the goalie is standing up.

H. The handling of The Kozac Cut will resemble a conventional goalie stick. The new ergonomic grips will allow the goalie to use the stick in a defensive manner as well as use it conventionally as an offensive device. The blade will have a conventional angle designed by the individual player. Players and goalies will bend their blades to their own specifications or have them bent in the manufacturing process.

I. NHL RULES: 10.2 Goalkeeper's Stick—In the case of a goalkeeper's stick there shall be a knob of white tape or some other protective material approved by the league. This knob must not be less than one-half inch (½') thick at the top of the shaft.

J. As indicated in the rule above, conventional goalie sticks are wrapped at the top of the shaft with tape to citable the player TO easily pick up or retrieve the stick if he/she drops it during play. The rule also has the effect of raising the stick above the playing surface do to the thickness of the tape, preventing good playing-surface contact. The invention, The Kozac Cut, allows the player to place the stick parallel to the playing surface and the knob of tape will not interfere with the surface-contact, preventing the puck (or object) from passing under and through.

K. Having described the present invention, The Kozac Cut, in reference to the Drawings, those skilled in the art will appreciate that the invention is not limited to this specific embodiment and the modifications may be made therein without departing from the scope of the present invention.

What is claimed is:

1. A hockey goalie stick comprising:

a blade, a paddle, and a shaft rigidly connected together;

the shaft having a substantially constant cross-section from a proximal to a distal end; the shaft comprising:

a distal grip portion and a proximal grip portion extending along a first longitudinal axis; and a middle portion, extending between the distal grip portion and the proximal grip portion, having a second longitudinal axis which is offset, but parallel, to the first longitudinal axis and having a first surface along an edge thereof;

wherein the middle portion is continuous with the distal and proximal grip portions via two 45 degree bends;

the paddle extending from the proximal grip portion of the shaft along the first longitudinal axis, a paddle width being wider than the shaft and having a paddle surface coplanar with the first surface of the middle portion;

wherein the shaft and paddle are configured such that the offset between the distal and proximal grip portions and the middle portion surface and paddle surface allows the distal and proximal grip portions to be taped and/or held by a player while the middle portion surface and the paddle surface are laid flush on a playing surface to prevent a puck from passing between either the paddle or the middle portion of the shaft and the playing surface; and the blade having two sections, each having a width substantially the same as the width of the paddle; a first section of the blade extending from the paddle at about a 45 degree angle and a second section of the blade extending from the first section of the blade at about a 30 degree angle such that the first and second sections allow contact of the blade with a playing surface when the shaft is oriented at a plurality of different positions.

* * * * *